United States Patent [19]

Tajima

[11] Patent Number: 4,542,980

[45] Date of Patent: Sep. 24, 1985

[54] APPARATUS FOR FIXING IMAGES

[75] Inventor: Hatsuo Tajima, Matsudo, Japan

[73] Assignee: Canon Kabushiki Kaisha, Tokyo, Japan

[21] Appl. No.: 335,741

[22] Filed: Dec. 30, 1981

[30] Foreign Application Priority Data

Jan. 15, 1981 [JP] Japan ..... 56-4244

[51] Int. Cl.[4] ..... G03G 15/20

[52] U.S. Cl. ..... 355/14 FU; 219/10.55 A; 219/10.55 R; 219/216; 355/3 FU

[58] Field of Search ..... 355/3 R, 3 FU, 14 FU; 219/10.55 F, 10.55 R, 10.55 A, 10.55 E, 216

[56] References Cited

U.S. PATENT DOCUMENTS

| | | | |
|---|---|---|---|
| 3,263,052 | 7/1966 | Jeppson et al. | 219/10.55 A |
| 3,993,124 | 11/1976 | Mueller | 355/3 FU X |
| 4,187,405 | 2/1980 | Puschner et al. | 219/10.55 A |
| 4,399,341 | 8/1983 | Yasuoka | 219/10.55 A X |
| 4,435,072 | 3/1984 | Adachi et al. | 219/10.55 A X |

FOREIGN PATENT DOCUMENTS

| | | | |
|---|---|---|---|
| 38171 | 10/1974 | Japan . | |
| 20039 | 2/1977 | Japan . | |
| 59149 | 5/1979 | Japan | 355/3 FU |
| 117179 | 9/1980 | Japan | 355/3 FU |

*Primary Examiner*—Fred L. Braun

*Attorney, Agent, or Firm*—Fitzpatrick, Cella, Harper & Scinto

[57] ABSTRACT

An image recording apparatus includes a high frequency radiation type fixing device in which high frequency radiation is conveyed through a solid dielectric material positioned to fix an unfixed image on a recording material and a heat absorbing device is provided for controlling the temperature of the solid dielectric material so as to prevent overheating of the dielectric material.

19 Claims, 18 Drawing Figures

APPARATUS FOR FIXING IMAGES

BACKGROUND OF THE INVENTION

1. Field of the Invention

The present invention generally relates to image recording apparatus such as copying machines and data recorders. More particularly, the present invention relates to such image recording apparatus in which unfixed images which arrive at the fixing station of an image forming process are fixed on an image supporting member such as a recording paper by applying thereto a high frequency wave.

2. Description of the Prior Art

In the art there have been already known heat fixing apparatus employing high frequency waves such as microwaves. Some examples of such fixing apparatus are disclosed in Japanese Patent Application Publication No. 38,171/1974, Japanese Patent Application Laid-open No. 20,039/1977 and Japanese Patent Application Publication No. 10,865/1979. These known high frequency heat fixing apparatus have solved various problems involved in the so-called external heat fixation. Improvements attained by these prior inventions are as follows:

The waiting time required to obtain the condition necessary for fixing was substantially reduced.

The danger of recording material such as paper catching on fire was removed. In the conventional external heat fixing apparatus, the possibility of such danger was not small in the case where the recording paper got jammed or stayed for a long time in the area of the fixing station due to some type of trouble.

Troubles associated with creasing of the recording material and/or distortion of images were removed.

To aid in a better understanding of the present invention, a further detailed description of the prior art apparatus will be made with reference to FIGS. 1 to 4 of the accompanying drawings.

FIGS. 1 and 2 show an example of the high frequency heat fixing apparatus according to the prior art wherein FIG. 1 is a perspective view thereof and FIG. 2 is a sectional view of the essential part thereof.

The apparatus uses a hollow microwave waveguide as the waveguide member 8 of high frequency application means.

Designated generally by 1 is a microwave generator for generating a microwave which has the electric field component in the transmission direction 2. Within the microwave generator 1 there is used a magnetron. 3 is a hollow waveguide of rectangular shape for transmitting the microwave in the direction of arrow 2 through the tube. The waveguide 3 is disposed in parallel to a recording material 7 carrying thereon a visualized image (toner image) indicated by 6 in FIG. 2. The recording material 7 is moved in sliding fashion on the waveguide 3 in the direction of arrow 11. During the slide movement of the recording member 7 the backside surface of the recording material faces the surface of the waveguide 3 on which a plural number of slits 4 are provided. Through the slits 4 the microwave is emitted out from the interior of the waveguide and is applied to the recording material 7 and also to the visualized image thereon. The applied microwave effects fixing of the visualized image on the recording material (more concretely, fixing is effected mainly by the phenomenon of self-heating and melting of the visualized image which absorbed the high frequency wave).

According to the prior art, the plural number of slits 4 are regularly arranged in parallel to each other and at an angle, for example, at 45° relative to the recording material moving direction 11. As the slits 4 are arranged in inclined fashion relative to the recording material moving direction 11, any portion of the recording material will pass over any portion of any slit 4. Therefore, it is assured that the microwave energy will be applied to the entire surface of the recording material without any loss of the energy by leakage of the microwave.

Designated by 5 is a microwave absorber to attenuate the microwave energy generated in the waveguide 3. Since the hollow waveguide 3 is sandwiched in between the microwave absorber 5 and the microwave generator 1, the microwave energy within the waveguide is damped down and extinguished.

The fixing apparatus according to the prior art in which a hollow microwave guide is used as the high frequency application means has, however, some disadvantages for practical use in an image forming apparatus.

Firstly, it takes up a large space. Secondly, it is difficult to obtain microwave energy of high density. Thirdly, it suffers greatly from contamination dust and particles which originate from the developer and the recording material make dirty not only the outer surface of the microwave waveguide but also the interior thereof through the slits 4. Moreover, it absorbs moisture in the air and in the recording material. This dust and moisture cause a substantial loss of energy. Therefore, the waveguide requires frequent cleaning. Lastly, the edge of the recording material is often caught in the slit 4 thereby hindering the recording material from being moved smoothly.

To solve the above problems there has been proposed an improved high frequency heat fixing apparatus as shown in FIGS. 3 and 4. The apparatus has a compact construction and is operable with a higher efficiency of high frequency heating. FIG. 3 is a perspective view of the improved apparatus and FIG. 4 is a sectional view of the essential part thereof.

In this apparatus, an upper conductor plate 9, a solid dielectric substance 12 and a lower conductor plate 10 constitute a high frequency application means. As seen in FIGS. 3 and 4, the upper conductor plate 9 is flat and has a plural number of slits 4 the function of which is the same as that of the slits shown in FIGS. 1 and 2. The conductor plate 9 is, for example, a metal plate. The solid dielectric substance 12 is, for example, an alumina porcelain, steatite porcelain, white mica or ceramics. The lower conductor plate 10 may be also a metal plate and it is disposed in opposition to the upper conductor plate 9 through the dielectric substance 12. The upper and lower conductor plates 9 and 10 are adhered to the top surface and the backside surface of the solid dielectric substance 12 respectively. The size of the conductor plates 9, 10 measured in the direction of the microwave being transmitted is longer than that of the recording material. But, the length $l_{10}$ of the lower conductor plate 10 measured in the direction of the recording material being moved is smaller than the length $l_9$ of the upper conductor plate 9 in the same direction. As seen in FIG. 4, the lower conductor plate 10 is disposed in opposition to the openings of the slits 4.

The above described high frequency application means composed of a conductor plate 9 provided with slits 4, a solid dielectric substance 12 and a conductor plate 10 has particular advantages over that shown in FIGS. 1 and 2. The use of dielectric substance 12 enables the transmission of the microwave generated from the oscillator with a higher microwave density in a smaller cross-section. Therefore, it is possible to reduce the size of high frequency application means.

However, as compared with the high frequency application means shown in FIGS. 1 and 2, the high frequency application means shown in FIGS. 3 and 4 has some drawbacks. The dielectric substance in the latter is heated by the microwave during transmission and it becomes fatigued by heat in a relatively short period of time. For this reason, it is not possible to increase the output of the microwave generator very high. In addition, it is necessary to provide means for effectively cooling said high frequency application means, which in turn makes the structure of the fixing apparatus large and complicated.

SUMMARY OF THE INVENTION

Accordingly, it is a general object of the invention to provide a novel image forming apparatus which eliminates the above drawbacks.

More specifically, it is an object of the invention to provide an image forming apparatus having a high frequency application means which assures sufficiently high durability for continuous use for a long period of time.

It is another object of the invention to provide an image forming apparatus with application of high frequency waves which has a compact and small construction without the above drawbacks and which is operable at higher efficiency, is durable for a long period of use and in which maintenance is easy.

It is a further object of the invention to provide an image forming apparatus which enables application of high frequency waves to unfixed images always in a stable state for a long time and which can surely fix the unfixed images by the high frequency waves without leaving any portion of the image unfixed.

Other and further objects, features and advantages of the invention will appear more fully from the following description.

DESCRIPTION OF PREFERRED EMBODIMENTS

Figure 5:
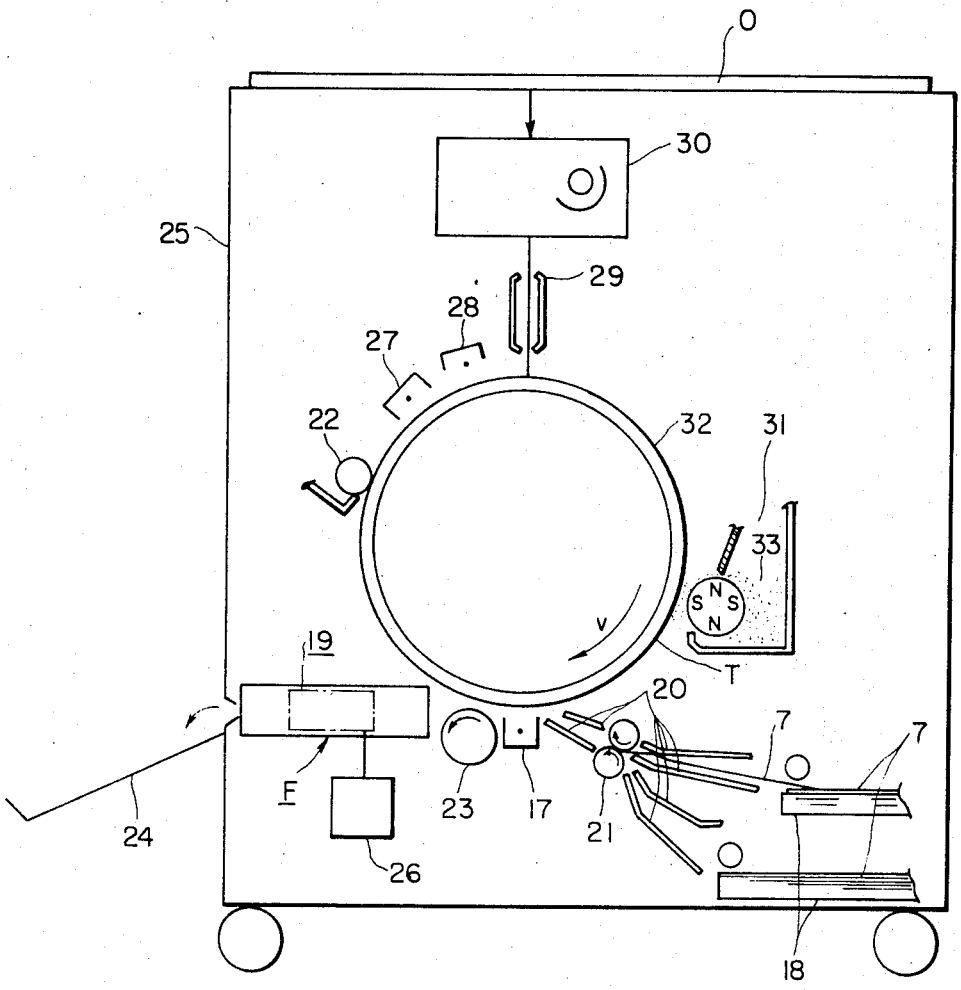
FIG. 5 is a view illustrating an embodiment of the invention.

Referring first to FIG. 5 an embodiment of the present invention will be described.

In the image forming apparatus shown in FIG. 5, a photosensitive drum 32 having a photosensitive layer provided thereon in the manner known per se is driven by a driving source (not shown) in response to a copy signal. When driven, the drum 32 rotates in the direction of arrow at a speed of v. At the first step, the drum 32 is pre-discharged by a charger for pre-discharging 27. Thereafter, the photosensitive drum 32 is charged by a primary charger 28 and then it is subjected to a secondary discharging by a secondary charger 29. Simultaneously with it, the image of an original O is imagewise projected on the photosensitive drum 32 through an optical apparatus 30 with a desired magnification (one-to-one magnification, deduction or enlargement). For this imagewise exposure, the optical apparatus 30 comprising optical elements and means for moving the optical elements is moved to scan the original image or the original O or an original table (not shown) is moved relative to a stationary optical apparatus 30. After the imagewise exposure, the whole surface of the photosensitive drum 32 is uniformly exposed to light to form an electrostatic latent image on the drum surface. The latent image is developed with a developer by a developing device 31 to form a visualized image T. As the drum 32 rotates further, the visualized image T on the drum enters a transfer station where a transfer charger 17 is provided.

On the other hand, a recording material 7 fed from a cassette 18 is moved along a guide member 20. At a good timing adjusted by a register roller 21, the recording material 7 is conveyed to the position near the drum 32 to receive the visualized image T from the drum. At the transfer station, the recording material 7 is charged from its backside by the transfer charger 17 with a polarity opposite to that of the visualized image T. With the aid of this transfer charger, the visualized image T is transferred onto the recording material 7 from the drum 32. After transferring the image, the photosensitive drum 32 enters a cleaning station where the surface of the drum is cleaned up by a cleaning roller 22. Thus, the photosensitive drum 32 is ready for the next cycle of copying operation.

On the other hand, the recording material 7 carrying thereon the visualized image T is separated from the drum surface by the action of a separation roller 23 and then conveyed up to a fixing station F located close to the photosensitive drum. To move the recording material 7 up to the fixing station F there may be used a known conveying means. At the fixing station, the visualized image T is fixed on the recording material 7 as a result of dielectric heating induced by microwave of which a detailed description will be made later with reference to FIG. 6 and the following drawings.

The visualized image T is composed of a developing agent (or toner). As the main component of the toner there may be used dielectric material, electrically conductive material or magnetic material. These materials are exothermic under the action of waves in a certain frequency range as a result of eddy-current loss, dielectric loss, hysteresis loss, residual magnetic loss etc.

The recording material carrying the fixed image is discharged from the apparatus into a tray 24 located outside of the fixing station F and the whole body of the image forming apparatus. Although not shown, exhaust means comprising a pair of exhaust rollers is provided to discharge the recording material 7 into the tray 24.

In the fixing station F shown in FIG. 5 there are provided a microwave application means 19 and a control means 26 for controlling the operation of said microwave application means 19 encased in a known casing (not shown). At a determined timing, microwaves are generated and applied to the recording material 7 to fix the visualized image T on the recording material.

Some embodiments of the fixing station F will be described hereinafter with reference to FIGS. 6 to 18.

Figure 6:
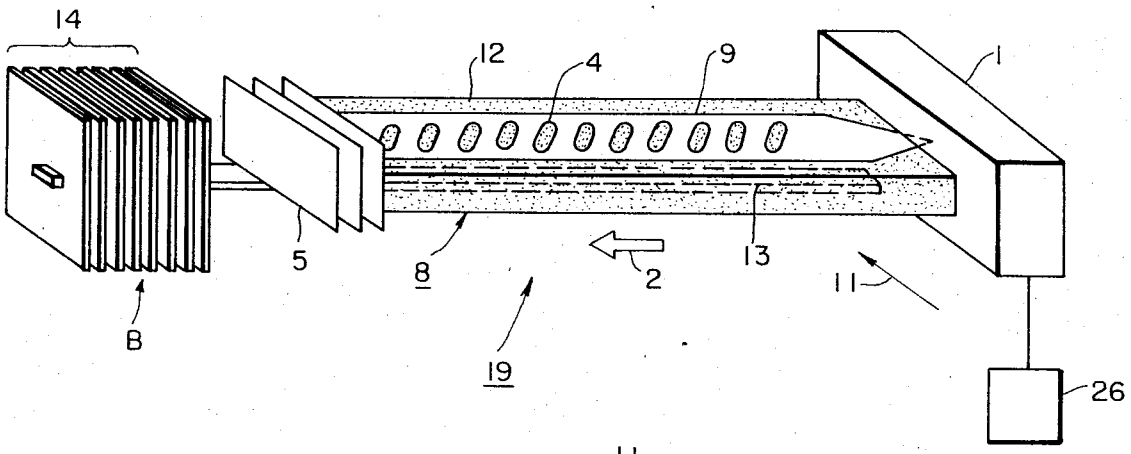
FIG. 6 shows an embodiment of the fixing station F in FIG. 5.
Figure 7:
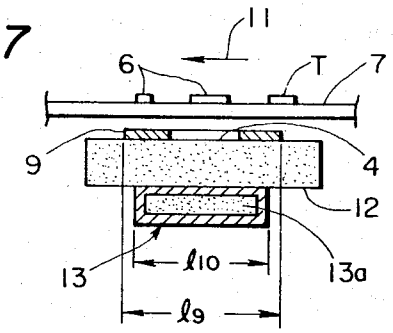
FIG. 7 is a cross-sectional view thereof along the direction of the recording material being moved.

FIGS. 6 and 7 show the first embodiment of the fixing station F in perspective view and in cross-sectional view.

Figure 4:
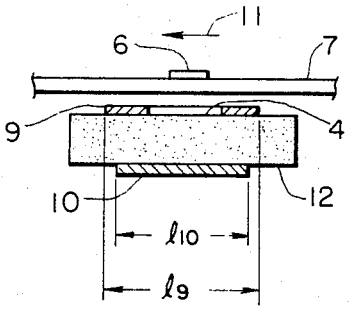
FIG. 4 is a cross-sectional view thereof along the direction of the recording material being moved.

In FIGS. 6 and 7, the recording material 7 carrying thereon the visualized image T is moved in the direction of arrow 11. 13 is a heat absorbing means or pipe made of metal or the like and in a box-like (or tube-like) shape. The heat pipe 13 is filled with heat transfer medium 13*a* and is air-tightly sealed. The heat pipe 13 is firmly fixed on the underside surface of a dielectric substance 12 so that the heat pipe can serve also as the conductor plate 10 of waveguide member 8 of microwave application means 19 previously described with reference to FIG. 4. Fixed on the upper surface of the solid dielectric substance 12 is a flat conductor plate 9. 1 is a microwave generator. The heat pipe 13 is disposed in parallel to the conductor plate 9 and extends linearly from a position near the microwave generator 1 in the microwave running direction 2. The heat pipe 13 has an extension extending beyond a microwave absorber 5. At the extension, the heat pipe 13 has a number of radiation fins 14 as cooling means. On the inner wall of the heat pipe 13 there are provided wicks to circulate the working liquid that is a kind of heat medium 13*a* by a capillary action. As previously mentioned, the heat pipe 13 is a closed pipe containing a suitable amount of the working liquid. All non-condensable gases such as air are previously removed from the pipe. Therefore, the inner volume of the heat pipe is filled up with the working liquid and the saturated vapour thereof.

When a microwave is generated and transmitted through the dielectric substance 12 in the direction of arrow 2, the heat generated in the dielectric substance 12 is transmitted to the pipe 13 at the area in contact with the dielectric substance 12. At the heated area, the working liquid evaporates and therefore there is produced a pressure difference between the area and the radiation part B. Owing to the pressure difference, the vapour generated at the area moves toward the radiation part B at a high speed. At the radiation part B, the moved vapour condenses on the inner wall of the radiation part and the latent heat by evaporation is radiated out through the radiation fins 14. The working liquid condensed at the radiation part is returned back to the heating part in contact with the dielectric substance 12 under the capillary action of the wicks.

In the shown embodiment, a copper pipe containing water has been used as the heat pipe 13. However, it should be understood that any known and commercially available heat pipe may be used for this purpose. In this manner, according to the invention, the heat pipe 13 prevents the dielectric substance 12 from being overheated. The temperature of the dielectric substance can be maintained at an optimum level in an allowable temperature range.

As shown in FIG. 7, the length (width) $l_{10}$ of the heat pipe 13 (corresponding to the conductor plate 10) is smaller than the length (width) $l_9$ of the flat conductor plate 9. However, the shape and size of the heat pipe 13 may be selected suitably at one's will. Cooling efficiency for the dielectric substance 12 can be increased up by increasing the volume of the heat pipe.

As the working liquid serving as heat transfer medium there may be used various liquids. Preferably it is selected considering various factors such as thermal stability in use, compatibility with the used container tube and wicks and the optimum range of vapour pressure. Examples of the working liquid generally suitable for this purpose include furons, alcohols, ammonia, acetone, glycol ethers, water, liquid sodium, liquid potassium, diphenyl, dipheny oxide, triaryl dimethanes and silicone oil. The thermal conductivity of the heat transfer medium is preferably higher than that of the heat pipe 13.

Figure 8:
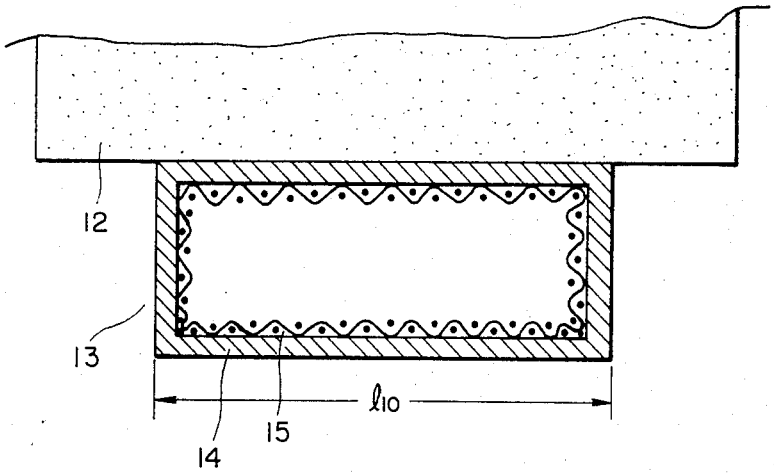
FIGS. 8 and 9 show modifications of the embodiment shown in FIG. 7.

FIG. 8 shows another form of the heat pipe 13.

Designated by 14 is a container containing a heat transfer medium as mentioned above. The container 14 is made of thermal conductive and corrosion resistent material. Provided on the inner wall of the container 14 are wicks 15 formed of such material which is wetable and has a capillary structure. For example, the wicks 15 may be formed by bonding a mesh, cloth fiber or felt onto the inner wall of the container 14. Also, the wicks 15 may be formed as a porous layer provided on the inner wall of the container 14 by electroplating or sintering.

Figure 9:
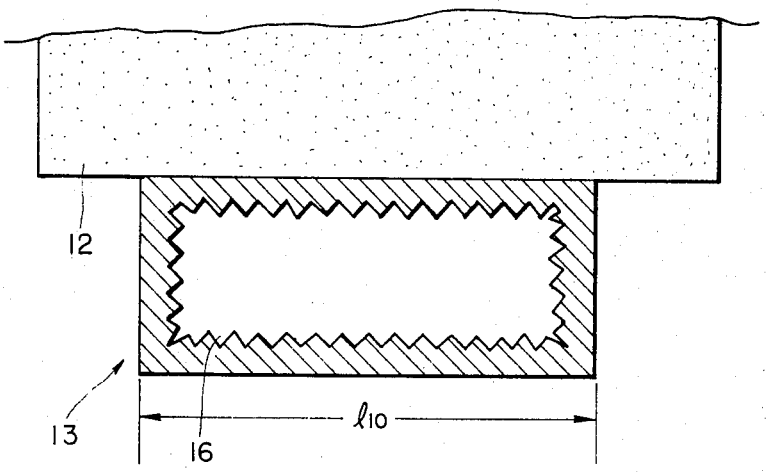

FIG. 9 shows a modification of the above form of the heat pipe. The cross-sectional shape of the heat pipe shown in FIG. 9 is similar to that shown in FIG. 8. However, in this modification, the inner wall of the heat pipe 13 has a great number of fine grooves 16 extending axially, that is, in the microwave running direction 2. In place of the axial fine grooves 16 there may be provided also a spiral fine groove on the inner wall of the heat pipe.

Figure 10:
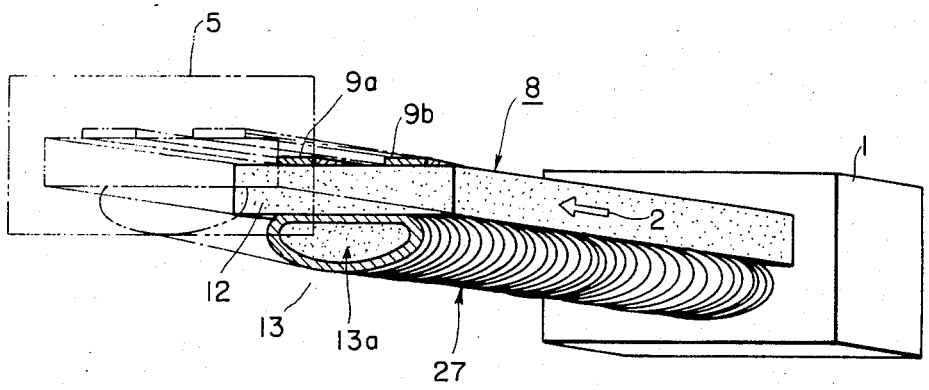
FIGS. 10 to 18 show other various embodiments of the invention respectively.
Figure 11:
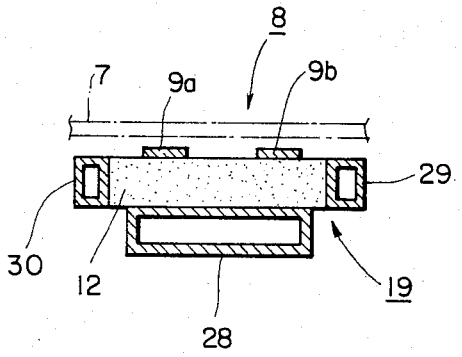

FIGS. 10 and 11 show other embodiments of microwave application means 19 in perspective view and in cross-sectional view respectively. The waveguide member 8 used in these embodiments includes two conductor plates 9*a* and 9*b* arranged on the same side surface of the dielectric substance 12. The two conductor plates 9*a* and 9*b* are spaced from each other to form a pair of electrodes and extend from the microwave generator 1 to the microwave absorber 5.

In the embodiment shown in FIG. 10, a heat pipe 13 is fixed on the opposite surface of the dielectric substance 12 to the conductor plates 9*a*, 9*b*. To prevent the dielectric substance from being overheated, the heat pipe 13 has a spiral fin 27 formed on the outer surface of the pipe containing a heat transfer medium 13*a*. The fin 27 may be provided only at the area of the heat pipe surface not in contact with the dielectric substance 12 while the remaining surface area in contact with the latter is closely adhered to the dielectric substance 12 to increase the thermal conductivity. Preferably the heat pipe 13 is made of such material which has a thermal conductivity higher than that of the dielectric substance 12. Examples of preferred material are ceramics, resin and metal.

In the embodiment shown in FIG. 11, three cooling members 28, 29 and 30 are provided to cool the dielectric substance 12. The dielectric substance is rectangular in cross-section. The cooling members 28, 29 and 30 are arranged in close contact with the three sides of the dielectric substance 12 respectively excepting the upper side on which conductor plates 9*a* and 9*b* are provided. These cooling members 28, 29 and 30 may be the same or different and can be selected suitably from many examples of the heat pipe 13 previously described or later described. The cooling members 28, 29 and 30 used in the shown embodiment are hollow metal tubes intimately bound to the three sides of the dielectric substance 12. These tubes contain no heat transfer medium therein.

Figure 12:
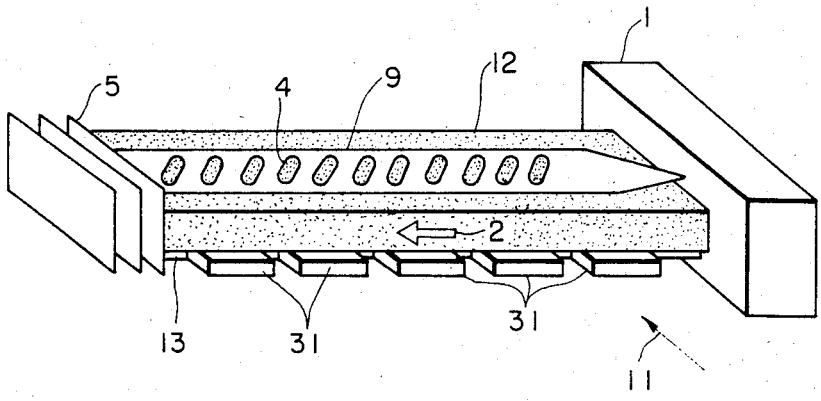

FIG. 12 shows a further improvement of the above microwave application means shown in FIG. 6. In this embodiment, the heat pipe 13 has many extensions 31 projecting beyond the dielectric substance 12 in the direction intersecting the microwave running direction 2. Each extension 31 is, therefore, formed as a projection extending outwardly beyond the width of the dielectric substance 12. In this heat pipe 13 also wicks as described above are provided to circulate the heat transfer medium and to increase the cooling efficiency.

Figure 13:
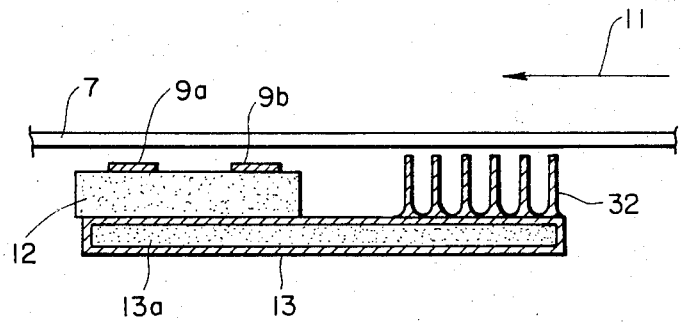

A further embodiment of microwave application means is shown in FIG. 13. In this embodiment, the heat pipe 13 has a larger width than the dielectric substance 12 with respect to the moving direction of recording material 7. The elongated width of the heat pipe 13 extends beyond the underside surface of the dielectric substance 12 up to a further upstream side of the recording material moving direction. At the upstream side, the heat pipe has a number of radiation fins 32. Therefore, the heat transfer medium 13*a* in the heat pipe 13 absorbs the heat generated in the dielectric substance 12 and moves to the area of the radiation fins 32 where the heat transfer medium is cooled by the radiation fins. After being cooled, the heat transfer medium flows back to the underside of the dielectric substance. In this manner, the heat transfer medium 13*a* circulates as a convectional flow relative to the direction of the recording material being moved. The heat radiated from the fins 32 is applied to the visualized image and the recording material prior to the application of microwave. By this pre-heating the energy efficiency of the microwave can be increased. The same effect will be obtained also in the embodiment shown in FIG. 12.

Figure 14:
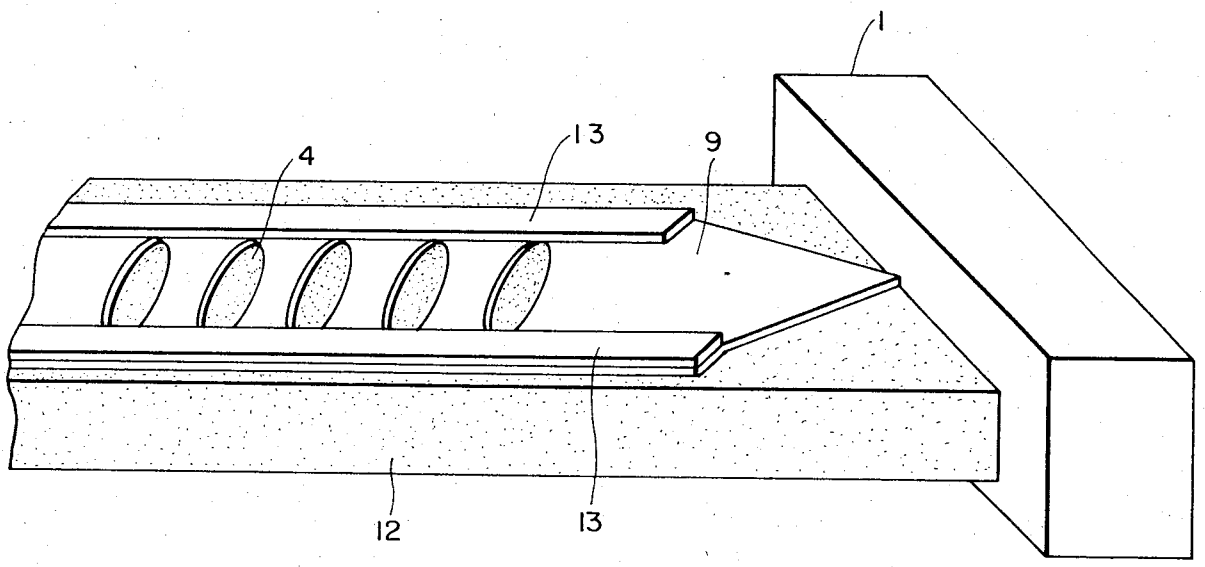

FIG. 14 shows a still further embodiment which is a modification of the FIG. 13 embodiment.

In this embodiment, the conductor plate 9 has slits 4 and cooling means is provided on the conductor plate 9. 13 is a heat pipe containing heat transfer medium as described above. A pair of heat pipes 13 are arranged along both ends of the slits in such manner that the slits 4 are interposed between the pair of heat pipes 13. These heat pipes 13 serve to stabilize the temperature in the vicinity of the conductor plate 9 so that a stable application of microwave radiation can be assured for a long time. While only a portion of the heat pipes 13 has been shown in FIG. 14, radiation fins as shown in FIGS. 6 or 13 may be provided on the portion not shown.

Figure 3:
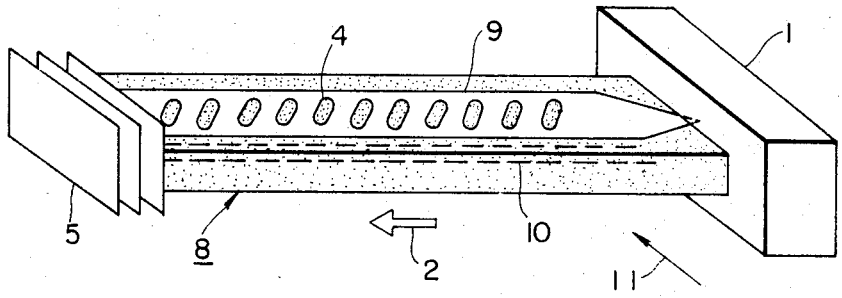
FIG. 3 is a perspective view of another high frequency generating apparatus to which the present invention is applicable.
Figure 2:
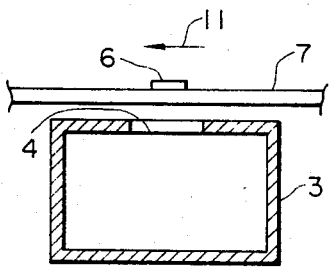
FIG. 2 PRIOR ART
FIG. 2 is a cross-sectional view thereof along the direction of the recording material being moved.
Figure 15:
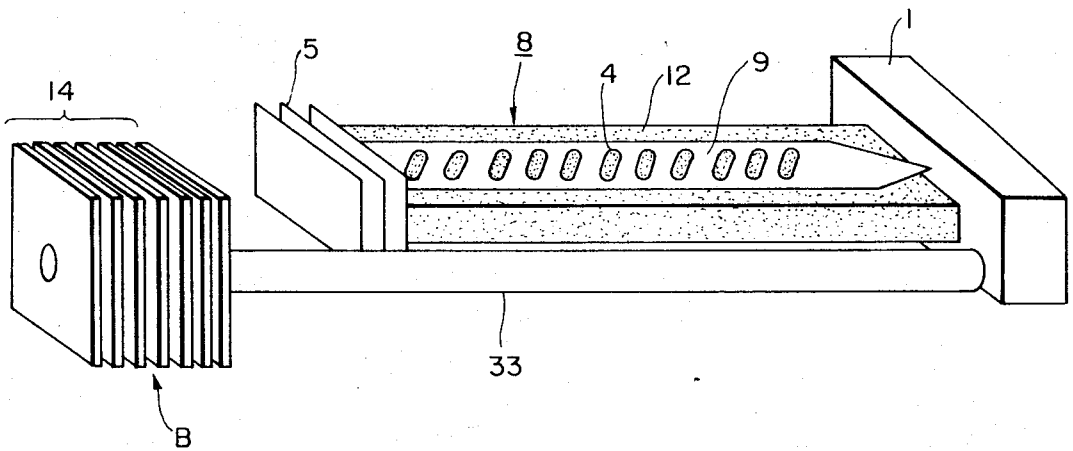

FIG. 15 shows a further embodiment in which a cooling means is provided close to the waveguide member 8 shown in FIG. 3. A cylindrical heat pipe 33 is disposed along one side surface of the dielectric substance 12 and in the area where the atmospheric temperature is substantially equal to the temperature of the dielectric substance 12. One closed end of the heat pipe 33 is bound to the microwave generator 1. At the other end, the heat pipe has a number of radiation fins 14. A heat transfer medium is contained in the heat pipe 33. By the heat reflux of the heat transfer medium the temperature of the atmosphere around the dielectric substance 12 is maintained at a desirable low level thereby preventing thermal fatigue of the dielectric substance 12.

Figure 16:
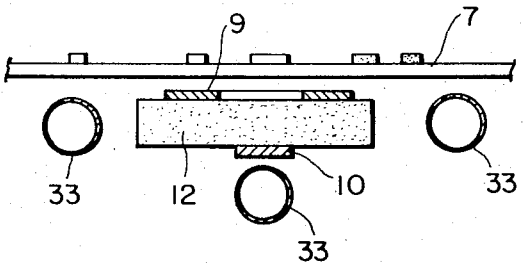

FIG. 16 shows a modification of the embodiment shown in FIG. 15. In this modification, three heat pipes 33 (radiation fins are not shown) are provided to cool the dielectric substance 12. Of the three heat pipes one is arranged immediately under the conductor plate 10 and the remaining two are along both sides of the dielectric substance 12. With this arrangement of three cooling means there is obtained not only increased cooling power with the increased number of cooling means but also a uniform distribution of temperature within the dielectric substance 12.

Figure 17:
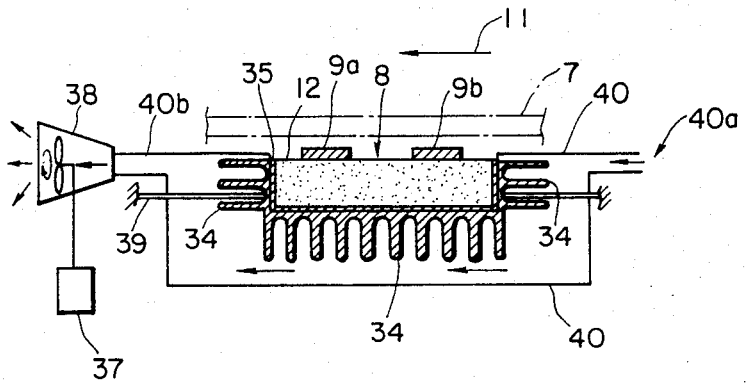
Figure 18:
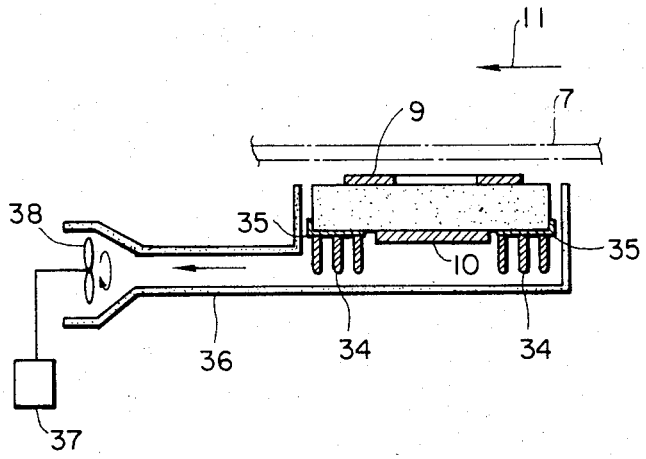

FIGS. 17 and 18 show other embodiments of microwave application means provided with a different kind of cooling means from the above embodiments. A waveguide as shown in FIG. 11 is used in the embodiment shown in FIG. 17 whereas a waveguide as shown in FIG. 3 is used in the embodiment shown in FIG. 18.

The embodiment shown in FIG. 17 includes a base member 35 and an outer casing 40. The base member 35 is concaved to receive therein the waveguide member 8. The base member 35 is fixed within the apparatus (FIG. 1) and a number of cooling fins 34 are provided around the outer surface of the base member 35. The casing 40 has two openings 40*a* and 40*b* located before and after the dielectric substance 12 respectively. The fins 34 are received in the space between the base member 35 and the outer casing 40. In one of the openings of the outer casing, namely, in the opening 40*b* there is provided a fan 38 to air cool the fins 34. The fan 38 is driven and controlled by known driving control means so as to prevent accumulation of radiated heat from the cooling fins 34 within the casing 40. Therefore, the cooling fins 34 can perform their function to cool the dielectric substance 12 always in a stable manner. The thermal conductivity of the base member 35 and cooling fins 34 is higher than that of the dielectric substance 12.

The embodiment shown in FIG. 18 is a modification of the above embodiment shown in FIG. 17. In this modification, cooling fins 34 are provided only at the underside part of the dielectric substance 12. A shielding case 36 surrounds the side surfaces of the dielectric substance 12. One opening of the shielding case 36 faces the area where the recording material 7 passes over. In another opening of the shielding case 36 there is provided a fan 38 which is turned by driving control means 37 to exhaust gases within the shielding case to the exterior.

In this manner, according to the embodiments shown in FIGS. 17 and 18 there is used air cooling means such as a fan in addition to cooling means such as a heat pipe to increase the cooling power. A further increase of cooling effect may be obtained by using materials having a higher thermal conductivity in any case.

Figure 1:
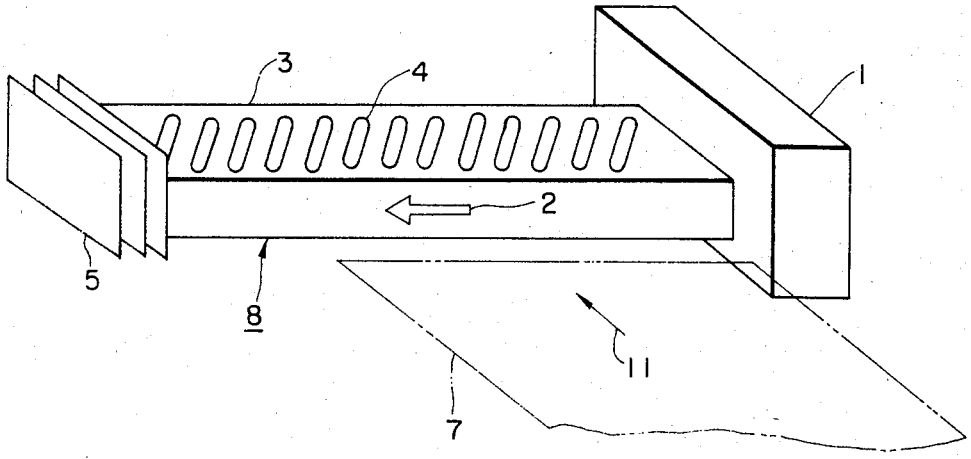
FIG. 1 PRIOR ART
FIG. 1 is a perspective view of a high frequency generator according to the prior art.

The heat pipe shown in the above may be used to cool not only the microwave transmission part of high frequency application means but also the microwave absorber 5 in FIG. 1 and other parts (heat generated within the fixing apparatus).

As readily understood from the foregoing, the present invention has many advantages over the prior art.

According to the invention, a high frequency application means (and other parts if desired) is effectively cooled by simple cooling means such as a heat pipe containing heat transfer medium (which may be present in a closed system or in an open system). This provides an image forming apparatus which is compact in structure and small in size and in which a high output microwave can be generated and transmitted for a long time without any reduction of useful energy.

While the present invention has been particularly shown and described with reference to preferred embodiments thereof, it is to be understood that the invention is not limited thereto but may be otherwise embodied by suitably combining two or more of the above embodiments and suitably selecting the entire construction of the apparatus. The present invention is applicable also to a high frequency induction fixing system.

Means for cooling high frequency application means may be of any form. Said cooling means is provided to prevent the members in said high frequency application means from being overheated and fatigued by heat. The dielectric substance (solid, liquid, powder or gaseous) used in said high frequency application means is a member which is especially apt to be overheated. Therefore, cooling means used in the invention should be able to effectively cool at least the solid high frequency transmission member comprising such dielectric substance. Preferably, said cooling means absorbs and dissipates at least overheating amount of thermal energy in a fashion of heat transfer or forcedly. Further it is preferred that said cooling means has a thermal conductivity higher than the atmosphere surrounding the overheated member and preferably higher than the thermal conductivity of the overheated member itself. A further improved cooling effect can be obtained thereby.

What I claim is:

1. An image forming apparatus comprising:

image forming means for forming an unfixed image;

high frequency fixing means for fixing the unfixed image on a recording material, said high frequency fixing means including means for producing high frequency radiation, a solid waveguide member made of a solid dielectric material having first and second opposed ends, said first end being connected with said producing means, and said waveguide member extending across a region where the recording material passes, for guiding the high frequency radiation from said producing means, and means for absorbing excess high frequency radiation, said absorbing means being connected to said second end of said solid waveguide member for absorbing said high frequency radiation which passes through said solid waveguide member from said producing means;

wherein said solid dielectric material has on its surface a conductive member forming a surface for concentrating the high frequency radiation to apply to the unfixed image; and heat absorbing means extending along substantially the whole length of said solid dielectric material of said waveguide member, and cooling means connected to said heat absorbing means for dissipating heat therefrom.

2. An image forming apparatus according to claim 1, wherein the apparatus includes means for conveying said recording material past said conductive member.

3. An image forming apparatus comprising:

image forming means for forming an unfixed image;

high frequency fixing means for fixing the unfixed image on a recording material, said high frequency fixed means including means for producing high frequency radiation, a solid waveguide member made of a solid dielectric material connected with said producing means extending across a region where the recording material passes, for guiding the high frequency radiation from said producing means, and means for absorbing excess high frequency radiation which passes through said solid waveguide member, wherein said solid dielectric material has on its surface a conductive member forming a surface for concentrating the high frequency radiation to apply to the unfixed image; and means associated with said fixing means for controlling the temperature of said solid dielectric material, said means extending along substantially the whole length of said solid dielectric material, wherein said temperature controlling means has an auxiliary heating means for absorbing the heat from said solid dielectric material and utilizing it for heating the recording material.

4. An image forming apparatus according to claim 3, wherein said auxiliary heating means is provided upstream with respect to the moving direction of the recording material relative to said solid dielectric material.

5. An image forming apparatus comprising:

image forming means for forming an unfixed image;

high frequency fixing means for fixing the unfixed image on a recording material, said high frequency fixing means including means for producing high frequency radiation, a solid waveguide member made of a solid dielectric material connected with said producing means extending across a region where the recording material passes, for guiding the high frequency radiation from said producing means, and means for absorbing excess high frequency radiation which passes through said solid waveguide member, wherein said solid dielectric material has on its surface a conductive member forming a surface for concentrating the high frequency radiation to apply to the unfixed image; and means associated with said fixing means for controlling the temperature of said solid dielectric material, said means extending along substantially the whole length of said solid dielectric material, wherein said temperature controlling means has a thermal absorbing member of thermal conductivity higher than that of said dielectric material.

6. An image forming apparatus according to claim 5, wherein said thermal absorbing member comprises a thermal medium.

7. An image forming apparatus according to claim 6, wherein said thermal medium comprises a working liquid and the saturated vapor thereof.

8. An image forming apparatus according to claim 5, wherein said thermal absorbing member is a heat pipe.

9. An image forming apparatus according to claim 8, wherein said heat pipe includes a wick, of which the inner surface is provided with mesh, cloth-fiber felt or a porous layer.

10. An image forming apparatus according to claim 8, wherein said heat pipe has on its inner surface a number of fine grooves extending in the direction of the movement of the high frequency radiation.

11. An image forming apparatus according to claim 10, wherein said grooves are spirally arranged.

12. An image forming apparatus according to claim 8, wherein said heat pipe has a spiral-shaped fin.

13. An image forming apparatus comprising:

image forming means for forming an unfixed image;

high frequency fixing means for fixing the unfixed image on a recording material, said high frequency fixing means including means for producing high frequency radiation, a solid waveguide member made of a solid dielectric material connected with said producing means extending across a region where the recording material passes, for guiding the high frequency radiation from said producing means, and means for absorbing excess high frequency radiation which passes through said solid waveguide member, wherein said solid dielectric material has on its surface a conductive member forming a surface for concentrating the high frequency radiation to apply to the unfixed image; and means associated with said fixing means for controlling the temperature of said solid dielectric material, said means extending along substantially the whole length of said solid dielectric material, wherein said dielectric material is selected from alumina porcelain, steatite porcelain, white mica or ceramics.

14. An image forming apparatus comprising:

image forming means for forming an unfixed image;

high frequency fixing means for fixing the unfixed image on a recording material, said high frequency fixing means including means for producing high frequency radiation, a solid waveguide member made of a solid dielectric material connected with said producing means extending across a region where the recording material passes, for guiding the high frequency radiation from said producing means, and means for absorbing excess high frequency radiation which passes through said solid waveguide member, wherein said solid dielectric material has on its surface a conductive member forming a surface for concentrating the high frequency radiation to apply to the unfixed image; and means associated with said fixing means for controlling the temperature of said solid dielectric material, said means extending along substantially the whole length of said solid dielectric material, wherein said high frequency radiation is microwave radiation and the unfixed image is formed with a developing agent having a dielectric member which produces heat by dielectric loss due to the microwave radiation.

15. An image forming apparatus according to claim 14, wherein said temperature controlling means is provided on said conductive member.

16. An image forming apparatus according to claim 14, wherein said temperature controlling means is associated with a surface of the solid dielectric material which is different from the surface from which the high frequency radiation is applied to the unfixed image.

17. An image forming apparatus according to claim 16, wherein said temperature controlling means is provided at a side opposite that on which said conductive member is provided and wherein another conductive member of good thermal conductivity forms an opposite electrode to said conductive member.

18. An image forming apparatus according to claim 14 wherein said temperature controlling means has means for exhausting the air around said solid dielectric material.

19. An image forming apparatus according to claim 18, wherein said exhausting means has heat radiation fins and a heat exhausting fan for discharging the heat from said solid dielectric material.

* * * * *